US008807537B1

(12) United States Patent
Vorrath

(10) Patent No.: US 8,807,537 B1
(45) Date of Patent: Aug. 19, 2014

(54) HANDRAIL INSTALLATION ASSISTING ASSEMBLY

(76) Inventor: Randy S. Vorrath, Buchanan, MI (US)

( * ) Notice: Subject to any disclaimer, the term of this patent is extended or adjusted under 35 U.S.C. 154(b) by 141 days.

(21) Appl. No.: 13/217,476

(22) Filed: Aug. 25, 2011

(51) Int. Cl.
*E04H 17/26* (2006.01)

(52) U.S. Cl.
USPC ..... 256/65.14; 256/59; 52/127.2; 52/184

(58) Field of Classification Search
USPC ..... 256/59, 65.14, DIG. 6; 52/127.2, 184
See application file for complete search history.

(56) References Cited

U.S. PATENT DOCUMENTS 2,531,778 A * 11/1950 Merner ..... 108/116
2,918,150 A * 12/1959 Blum ..... 256/65.02
3,256,658 A * 6/1966 Seery ..... 256/65.14
3,788,608 A 1/1974 Raymond et al.
3,881,699 A * 5/1975 Nusbaum ..... 256/59
3,924,834 A * 12/1975 Young ..... 256/59
4,666,131 A * 5/1987 Kettelkamp et al. ..... 256/DIG. 6
5,335,754 A * 8/1994 Gibson ..... 182/204
5,527,016 A 6/1996 Wilkerson, Jr.
5,628,119 A 5/1997 Bingham et al.
5,673,903 A 10/1997 Lewis
5,775,036 A * 7/1998 Stanley, Sr. ..... 52/127.2
6,038,829 A * 3/2000 Franks ..... 256/65.14
6,820,868 B1 11/2004 Reymus
6,908,075 B1 * 6/2005 Nichols ..... 256/DIG. 6
D568,184 S 5/2008 Rogell

* cited by examiner

*Primary Examiner* — Michael P Ferguson

(57) ABSTRACT

A handrail installation assisting assembly includes a base that has a top side, a front edge and a rear edge. A mount is attached to and extends upwardly from the base. A rod is attached to an upper edge of the mount. The rod extending laterally away from the mount to be positioned under a banister to support the banister.

4 Claims, 5 Drawing Sheets

HANDRAIL INSTALLATION ASSISTING ASSEMBLY

BACKGROUND OF THE DISCLOSURE

Field of the Disclosure

The disclosure relates to banister support devices and more particularly pertains to a new banister support device for supporting a banister so that it may be installed on a wall adjacent to a staircase.

SUMMARY OF THE DISCLOSURE

An embodiment of the disclosure meets the needs presented above by generally comprising a base that has a top side, a front edge and a rear edge. A mount is attached to and extends upwardly from the base. A rod is attached to an upper edge of the mount. The rod extending laterally away from the mount to be positioned under a banister to support the banister.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF THE DRAWINGS

The disclosure will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
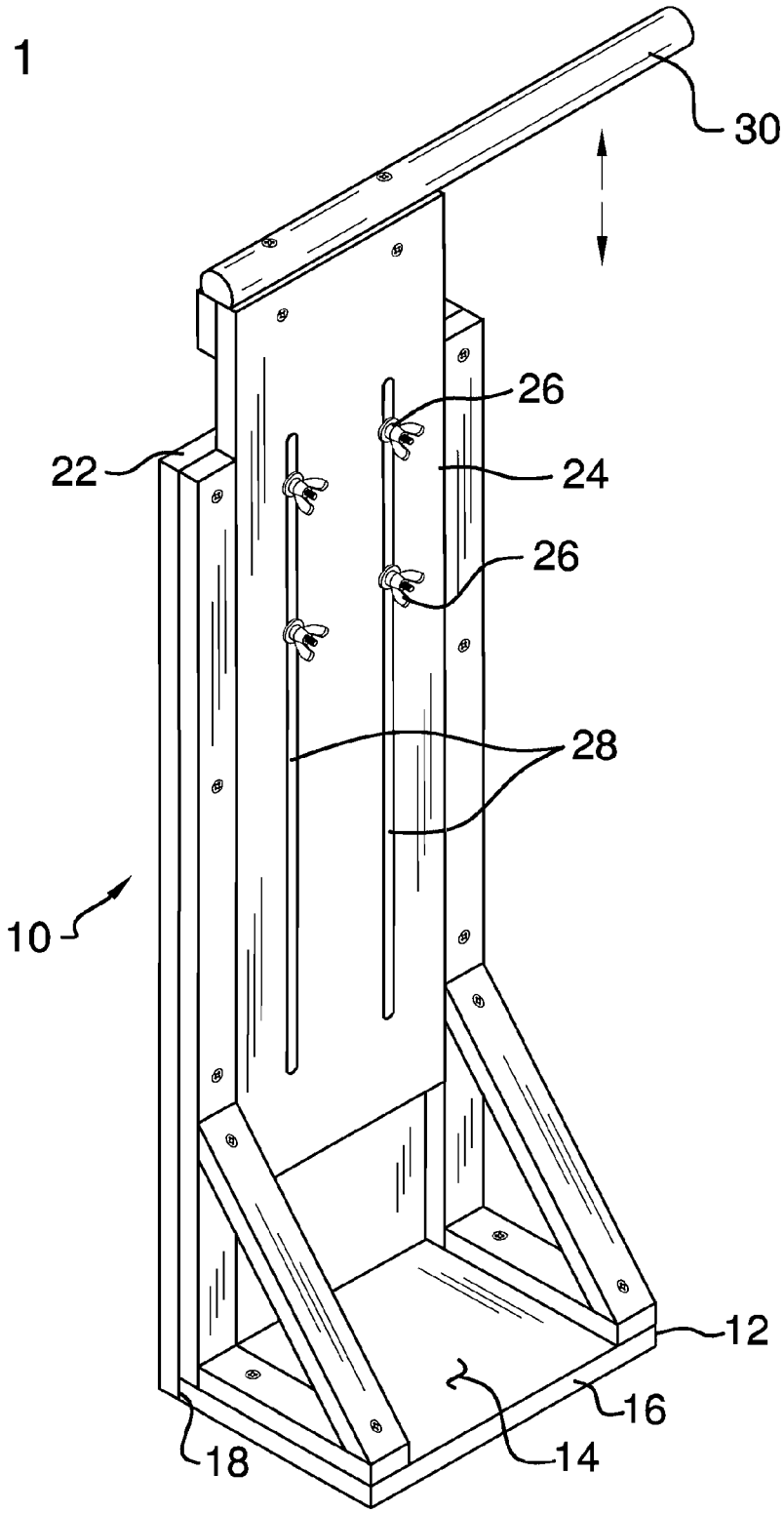
FIG. 1 is a front perspective view of a handrail installation assisting assembly according to an embodiment of the disclosure.
Figure 2:
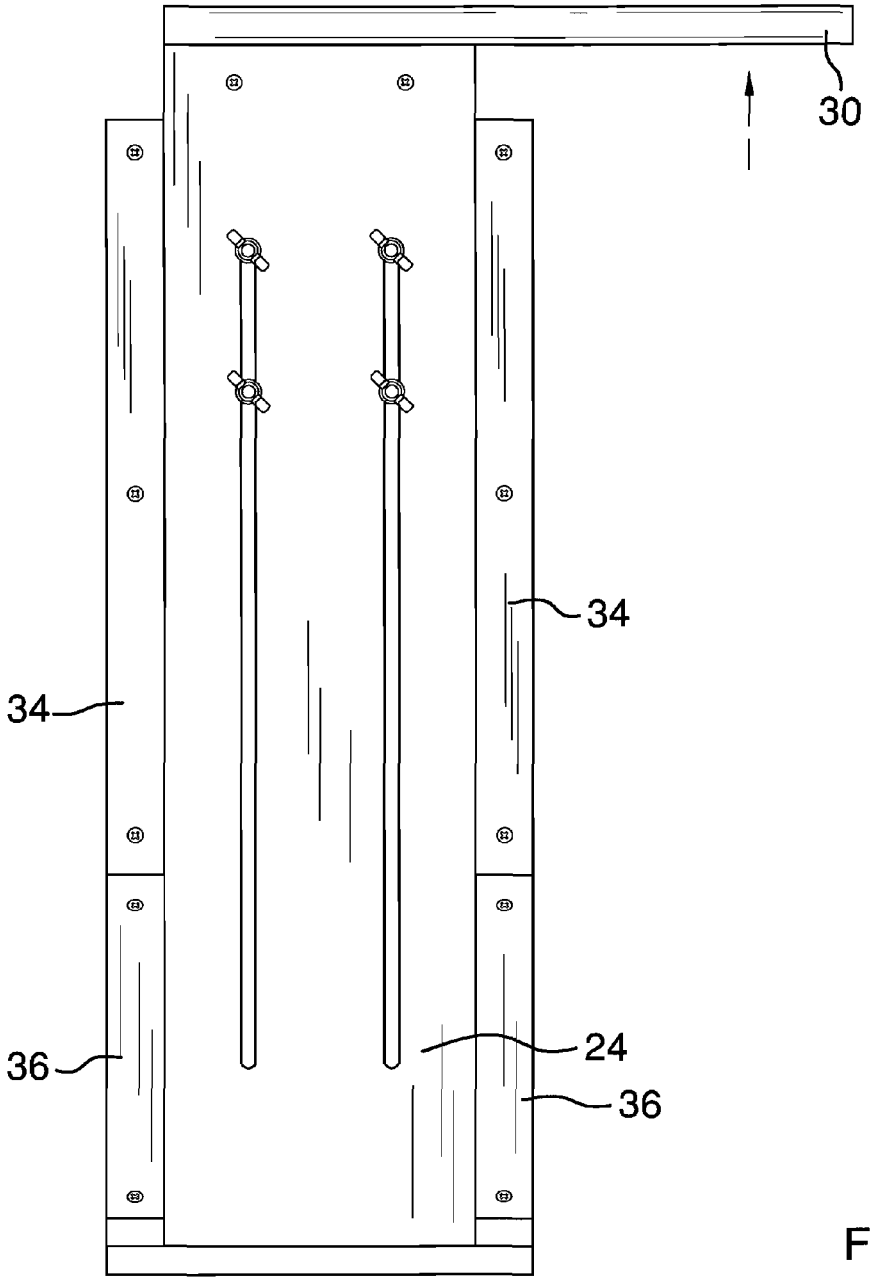
FIG. 2 is a front view of an embodiment of the disclosure.
Figure 3:
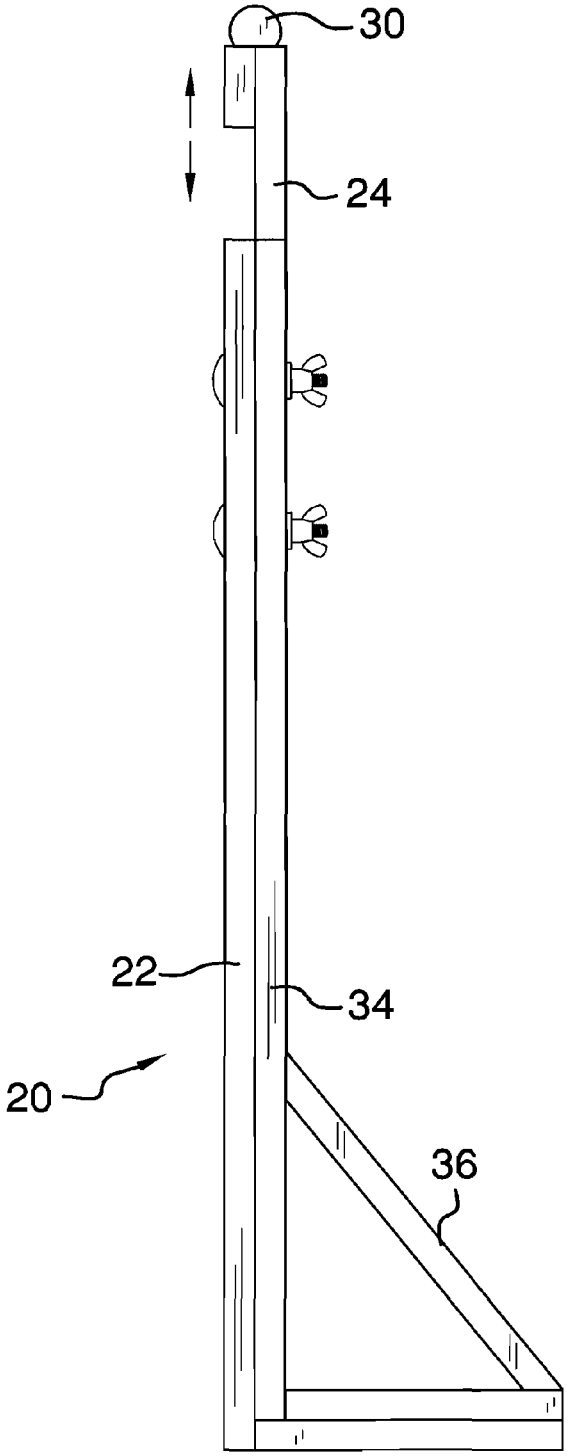
FIG. 3 is a side view of an embodiment of the disclosure.
Figure 4:
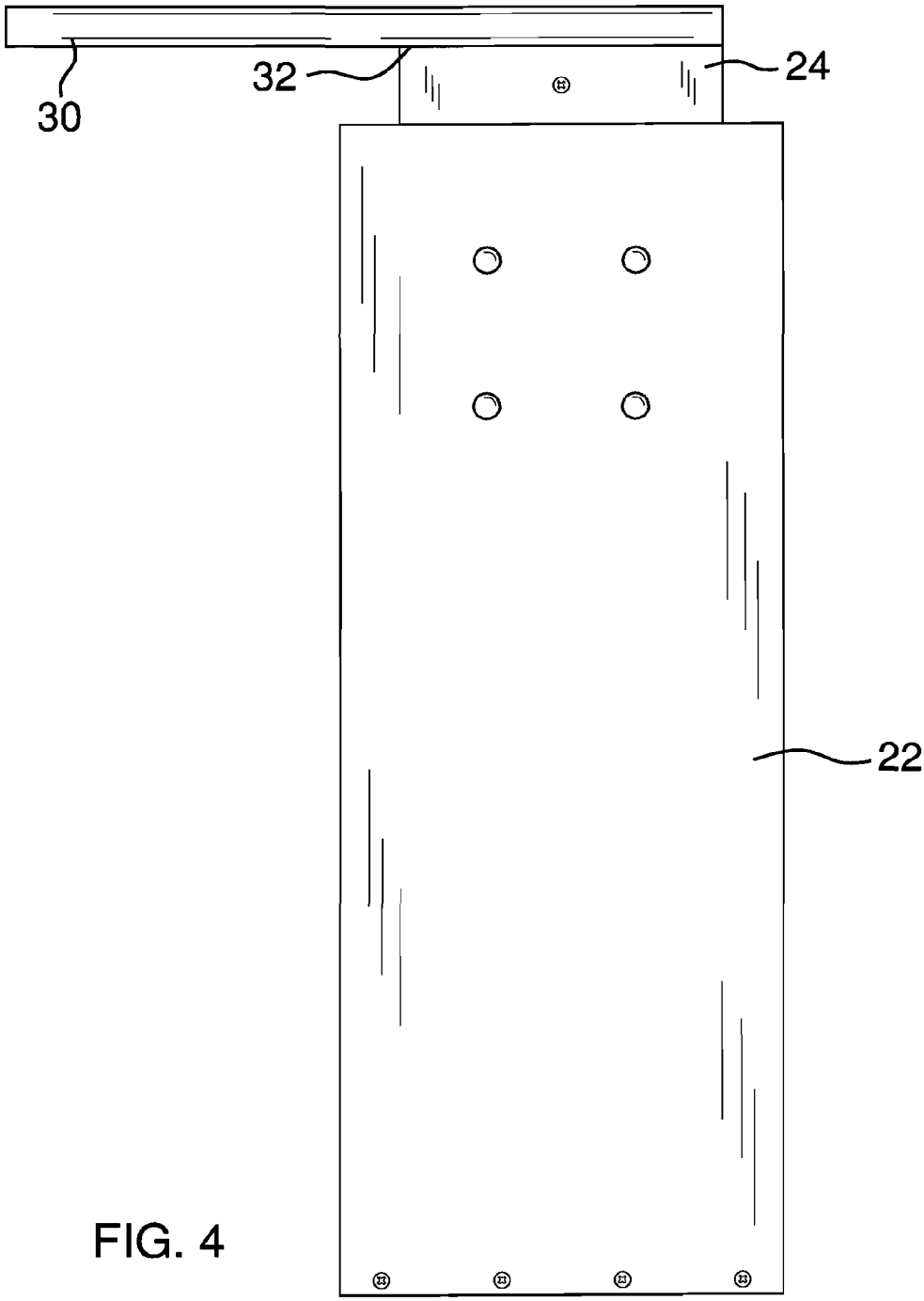
FIG. 4 is a rear view of an embodiment of the disclosure.
Figure 5:
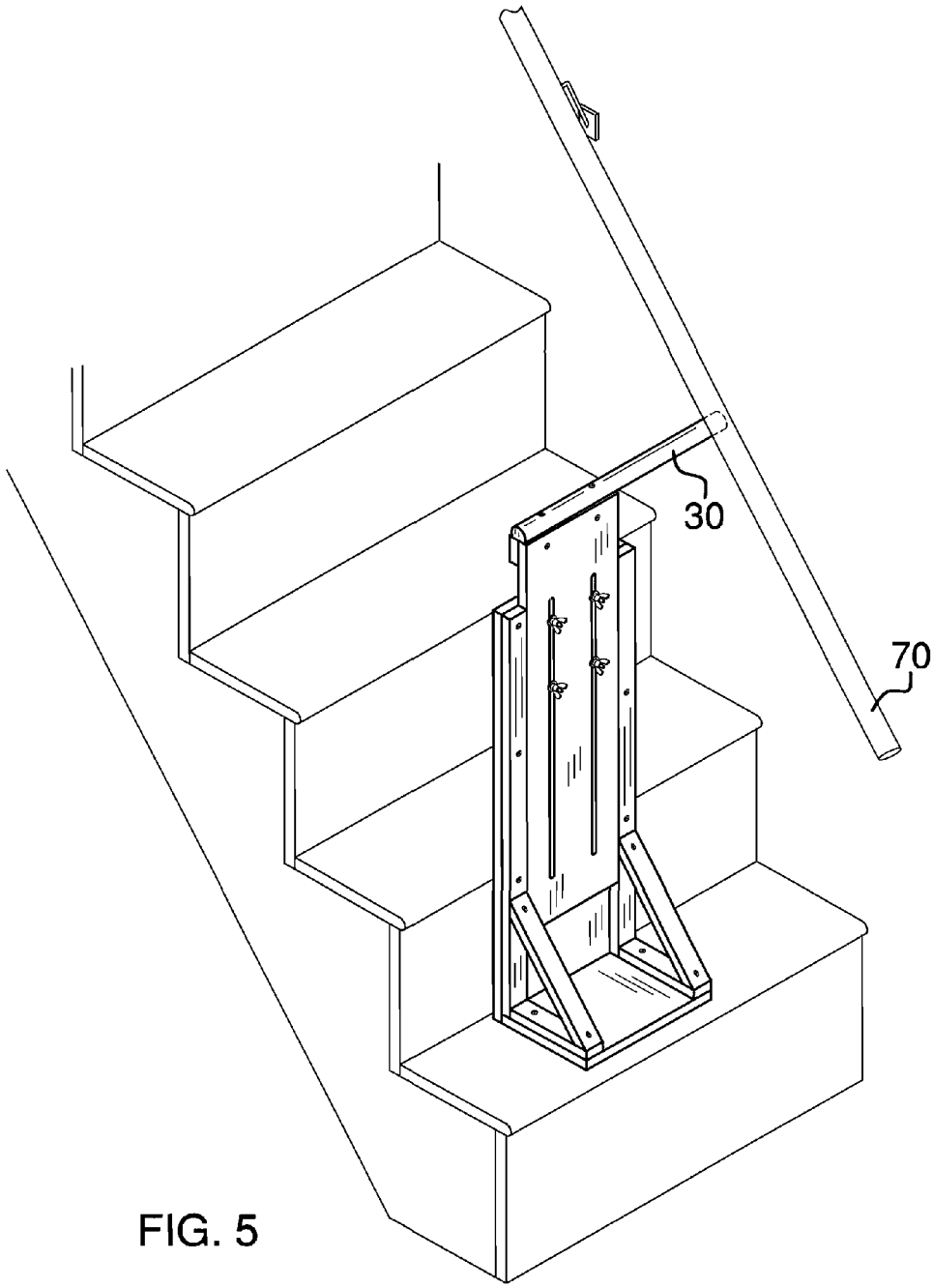
FIG. 5 is a perspective in-use view of an embodiment of the disclosure.

With reference now to the drawings, and in particular to FIGS. 1 through 5 thereof, a new banister support device embodying the principles and concepts of an embodiment of the disclosure and generally designated by the reference numeral 10 will be described.

As best illustrated in FIGS. 1 through 5, the handrail installation assisting assembly 10 generally comprises a base 12 that has a top side 14, a front edge 16 and a rear edge 18. A mount 20 is provided that includes a support wall 22 which is attached to and extends upwardly from the rear edge 18. The support wall 22 is oriented perpendicular to the base 12 to retain the support wall 22 in a vertical orientation. A slide 24 is mounted on the support wall 22 and is movable vertically on the support wall 22. A plurality of fasteners 26 releasably couples the slide 20 to the support wall 22. The fasteners 26 may include threaded bolts attached to the support wall 22 which extend through elongated slots 28 in the slide 24. Nuts threadably mounted on the bolts secure the slide 24 where needed.

A rod 30 is attached to an upper edge 32 of the slide 24. The rod 30 extends laterally away from the mount 20 and the support wall 22 in particular. The rod 30 is horizontally oriented. The rod 30 is configured to be positioned under a banister 70, or handrail, to support the banister 70 while the banister 70 is being installed.

A pair of guides 34 is attached to the support wall 20. The guides 34 are spaced from each other and the slide 24 is positioned between the guides 34 to restrict lateral movement of the slide 24 and ensure that the rod 30 remains horizontally oriented. Braces 36 are attached to and extend between the guides 34 and the base 12.

In use, the slide 24 is raised to a position to place the rod 30 where needed to support the banister 70 at a proper height while it is attached to a wall. The assembly 10 is used to support the banister 70 so that a person can install the banister 70 alone and without additional assistance.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure.

I claim:

1. A banister support assembly configured to retain a banister at a selected height from a stair to facilitate installation of the banister, said banister support assembly comprising:

a base having a top side, a front edge and a rear edge, a lower side of the base configured to seat upon a tread of a lower stair;

a mount being attached to and extending upwardly from said base, said mount having a width dimension and a depth dimension, said width dimension being greater than said depth dimension;

wherein said mount includes:

a support wall being attached to and extending upwardly from said rear edge, said support wall being oriented perpendicular to said base, a rear side of the support wall configured to abut a front edge of a tread of an adjacent upper stair;

a slide being mounted on a front side of said support wall, said slide being movable vertically on said support wall;

a plurality of fasteners releasably coupling said slide to said support wall to fix an upper edge of the slide at a selected height;

a rod being attached to the upper edge of said slide, said rod extending laterally away from said mount, said rod being configured to be positioned under a banister to support the banister at the selected height, said rod being elongated along a line oriented parallel to said width dimension; and wherein said mount is telescopic such that a height between said rod and said base is selectively adjustable.

2. The support assembly according to claim 1, wherein said rod is horizontally oriented.

3. The support assembly according to claim 1, further including a pair of guides being attached to said support wall, said guides being spaced from each other, said slide being positioned between said guides and restricting lateral movement of said slide.

4. A banister support apparatus configured to retain a banister at a selected height from a stair to facilitate installation of the banister, said apparatus comprising:

a base having a top side, a front edge and a rear edge, a lower side of the base configured to seat upon a tread of a lower stair;

a mount including:

a support wall being attached to and extending upwardly from said rear edge, said support wall being oriented perpendicular to said base, a rear side of the support wall configured to abut a front edge of a tread of an adjacent upper stair;

a slide being mounted on a front side of said support wall, said slide being movable vertically on said support wall;

a plurality of fasteners releasably coupling said slide to said support wall to fix an upper edge of the slide at a selected height;

said mount having a width dimension and a depth dimension, said width dimension being greater than said depth dimension;

a rod being attached to the upper edge of said slide, said rod extending laterally away from said mount and said support wall, said rod being horizontally oriented, said rod being elongated along a line oriented parallel to said width dimension, said rod being configured to be positioned under a banister to support the banister at the selected height; and a pair of guides being attached to said support wall, said guides being spaced from each other, said slide being positioned between said guides and restricting lateral movement of said slide.

* * * * *